US005107540A

United States Patent [19]

Mooney et al.

[11] Patent Number: 5,107,540

[45] Date of Patent: Apr. 21, 1992

[54] ELECTROMAGNETIC RESONANT VIBRATOR

[75] Inventors: Charles W. Mooney, Lake Worth; Irving H. Holden, Boca Raton; George J. Selinko, Lighthouse Point, all of Fla.

[73] Assignee: Motorola, Inc., Schaumburg, Ill.

[21] Appl. No.: 403,972

[22] Filed: Sep. 7, 1989

[51] Int. Cl.[5] ..... H04R 25/00; G08B 5/22

[52] U.S. Cl. ..... 381/192; 381/202; 381/193; 340/407; 340/825; 340/46

[58] Field of Search ..... 381/192, 193, 68.3, 381/203, 202; 340/407, 825.46; 181/157, 161, 164, 173

[56] References Cited

U.S. PATENT DOCUMENTS

| | | | |
|---|---|---|---|
| Re. 20,896 | 10/1938 | Greibach | 381/68.3 |
| 4,225,965 | 9/1980 | Baugh | 340/825.44 |
| 4,385,210 | 5/1983 | Marquiss | 381/203 |
| 4,628,907 | 12/1986 | Epley | 381/683 |
| 4,728,936 | 3/1988 | Pfänder et al. | 340/407 |
| 4,843,628 | 6/1984 | Hofer | 381/193 |
| 4,931,765 | 6/1990 | Rollins et al. | 340/391 |
| 5,023,504 | 6/1991 | Mooney et al. | 340/825.46 |

FOREIGN PATENT DOCUMENTS

| | | | |
|---|---|---|---|
| 0474943 | 4/1929 | Fed. Rep. of Germany | 381/202 |

*Primary Examiner*—Forester W. Isen
*Assistant Examiner*—Jason Chan
*Attorney, Agent, or Firm*—Philip P. Macnak; Vincent B. Ingrassia; William E. Koch

[57] ABSTRACT

An apparatus for effecting a vibrating motion comprises a resonant planar armature, a housing, an electromagnetic device attached to the housing for effecting an alternating electromagnetic field, a magnetic device coupled to the armature and to the electromagnetic field for alternatively moving the armature in a first and a second direction in response to the electromagnetic field. The resonant planar armature comprises a plurality of planar spring members arranged regularly about a central planar region within a planar perimeter region of the armature, and the spring members provide a restoring force normal to a movement of the central region of the armature caused by the alternating electromagnetic field.

17 Claims, 2 Drawing Sheets

ELECTROMAGNETIC RESONANT VIBRATOR

FIELD OF THE INVENTION

This invention relates in general to the field of electromagnetic vibrators, particularly to electromagnetic resonant vibrators for selective call receivers that provide a similar tactile sensory response as a conventional vibrator motor while requiring less power and space.

BACKGROUND OF THE INVENTION

Selective call receivers, including pagers, are typically used to alert a user of a message by producing an audio alerting signal. However, the audio signal may be disruptive in various environments and therefore, vibrators have been utilized to provide a silent alerting signal.

Vibrator motors are well known in the art and generally comprise a cylindrical housing having a rotating shaft along a longitudinal axis attached to an external unbalanced counterweight. Vibrator motors have proven successful for alerting a user of a received message, but conventional designs have been unreliable due to failure of the mechanism initiating the vibration, typically the unbalanced counterweight.

FIG. 1 of the drawings is a typical example of a conventional vibrator motor. Referring to FIG. 1, a conventional vibrator motor 100 comprises a cylindrical body 102, a longitudinal, rotating shaft 104, and an unbalanced, rotating counterweight 106. The cylindrical body 102 is held in place on a printed circuit board 108 by motor bracket 110. The counterweight 106 is attached to the protruding end of the shaft 104 on the vibrator motor 100. Operationally, the motor 100 is energized by a power source causing the shaft 104 and the counterweight 106 to rotate, resulting in the motor 100 vibrating and, consequently, the selective call receiver vibrating.

With the trend to miniaturization, the vibrator motor has become the largest component in silent alert pagers. It is, therefore, not possible to further significantly reduce the size of a silent alert pager unless the vibrator motor is reduced in size. However, it is important that the vibration level not be reduced since this would defeat the advantage of the size reduction.

To overcome the problems with the conventional vibrator motor, an electromagnetic resonant vibrator has been utilized as the frequency controlling element for generation of an alerting signal and also as a frequency responsive device that responds to a given signal. Such devices have included a vibratory member, such as a reed, having a natural resonant frequency, with a magnetic structure coupled thereto which causes vibrations of the reed at its natural resonant frequency. Electromagnetic resonant vibrators have also been proposed wherein an armature is mounted for lateral or rotary movement. The magnetic structure for such devices may include a first coil for exciting the armature, and a second coil for picking up signals in response to the vibrations, so that signals are coupled therebetween only at the resonant frequency of the vibratory member. The device must also provide isolation of the critical components from external shock and vibration influences. For example, if the unit is dropped or jarred, the reed should not vibrate and provide a response as though a signal had been received. These previously known devices were unstable; therefore, the systems were not resonant and their restoring force unbalanced, resulting in a larger power consumption than necessary.

Thus, what is needed is an improved vibrator in a selective call receiver for alerting a user of a received message.

SUMMARY OF THE INVENTION

Accordingly, it is an object of the present invention to provide an improved selective call receiver having an improved silent alert.

In carrying out the above and other objects of the invention in one form, there is provided an apparatus for effecting a vibrating motion, comprising a housing, an electromagnetic device attached to the housing for effecting an alternating electromagnetic field, a magnetic device coupled to the electromagnetic field for alternatively moving in a first (up) and a second (down) direction in response to the electromagnetic field, and a structure attached to the magnetic device and the housing for tuning modes in other than the first and second direction, the structure comprising a diaphragm having at least one spring integrally positioned thereon.

DETAILED DESCRIPTION OF THE INVENTION

Figure 1:
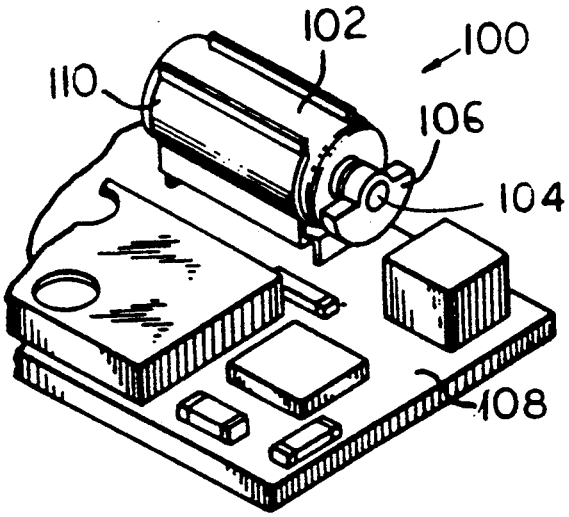
PRIOR ART FIG. 1
FIG. 1 is a perspective view of a conventional vibrator attached to a printed circuit board.
Figure 2:
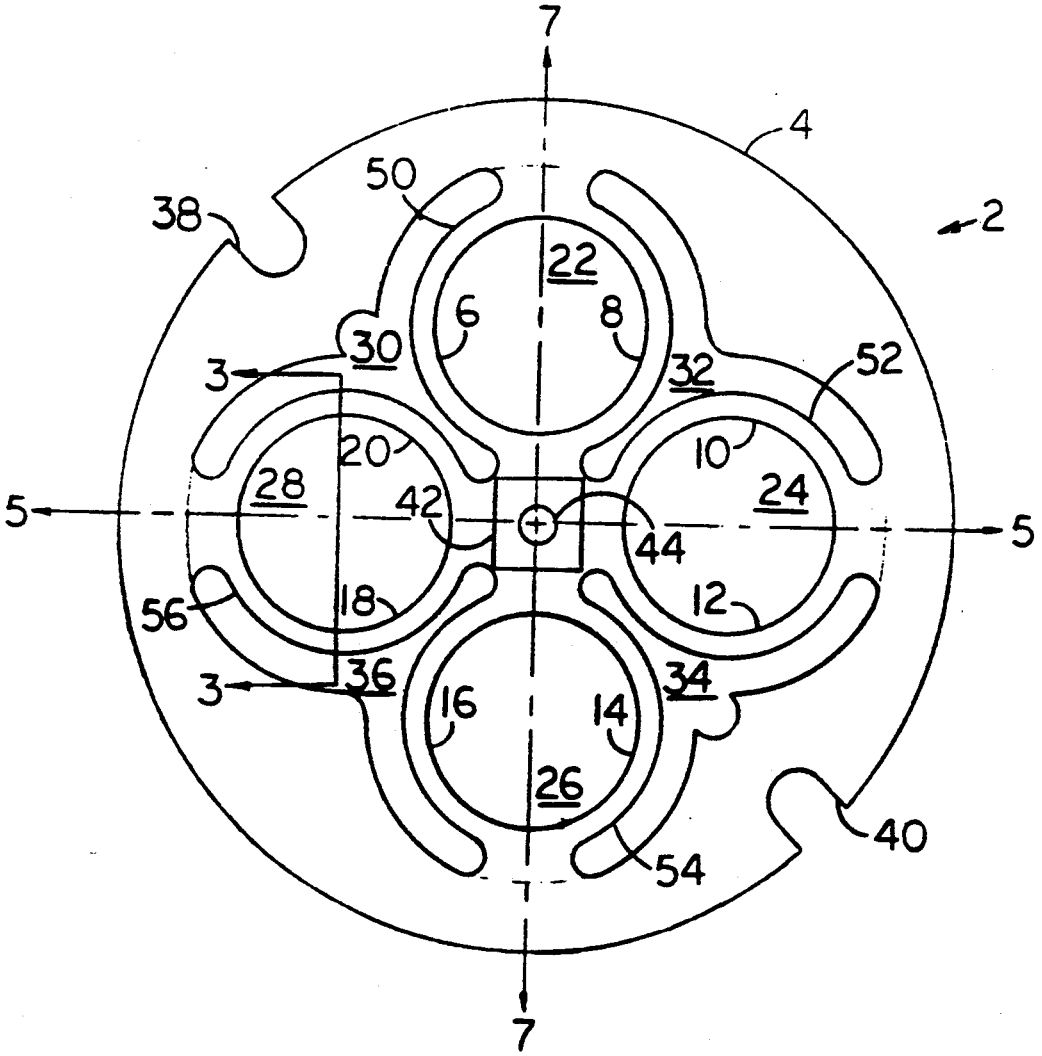
FIG. 2 is a top view of the armature in the preferred embodiment of the present invention.

Referring to FIG. 2, a preferred armature 2 comprises a body 4 including curved, substantially planar springs 50, 52, 54, and 56 integrally positioned therein, an etched surface 42, and an opening 44. The armature 2 may be manufactured by a single piece of metal, chemically etched to form the following configuration in the preferred embodiment. Each of the springs 50, 52, 54, and 56 comprise two members 6 and 8, 10 and 12, 14 and 16, and 18 and 20, respectively. The springs 50, 52, 54, and 56 are formed by circular openings 22, 24, 26, and 28 and curved openings 30, 32, 34, and 36, respectively. Parabolic openings 38 and 40 are formed for mounting purposes although other variations could be utilized.

In the preferred embodiment, the armature 2 is made of international nickel alloy 902, with springs 50, 52, 54, and 56, chemically etched to membrane thickness, typically 0.003 inches or less. This material is a constant modulus alloy so as to reduce temperature induced frequency changes and force impulse changes. The unique design of the armature 2 provides a linear spring rate due to the elastic bending of the members 6, 8, 10, 12, 14, 16, 18, and 20. Frequency tuning is preferably accomplished by adjusting the inside diameters of the springs 50, 52, 54, and 56 by a suitable etching, trimming, or grinding process. The ring geometry makes it possible to elongate each of the members 6, 8, 10, 12, 14, 16, 18, and 20 by 0.0015 inches without exceeding the required maximum fatigue stress level of 30,000 psi for the material selected in the preferred embodiment. It should be understood that the shapes and dimensions could change without varying from the intent of the invention.

Figure 3:
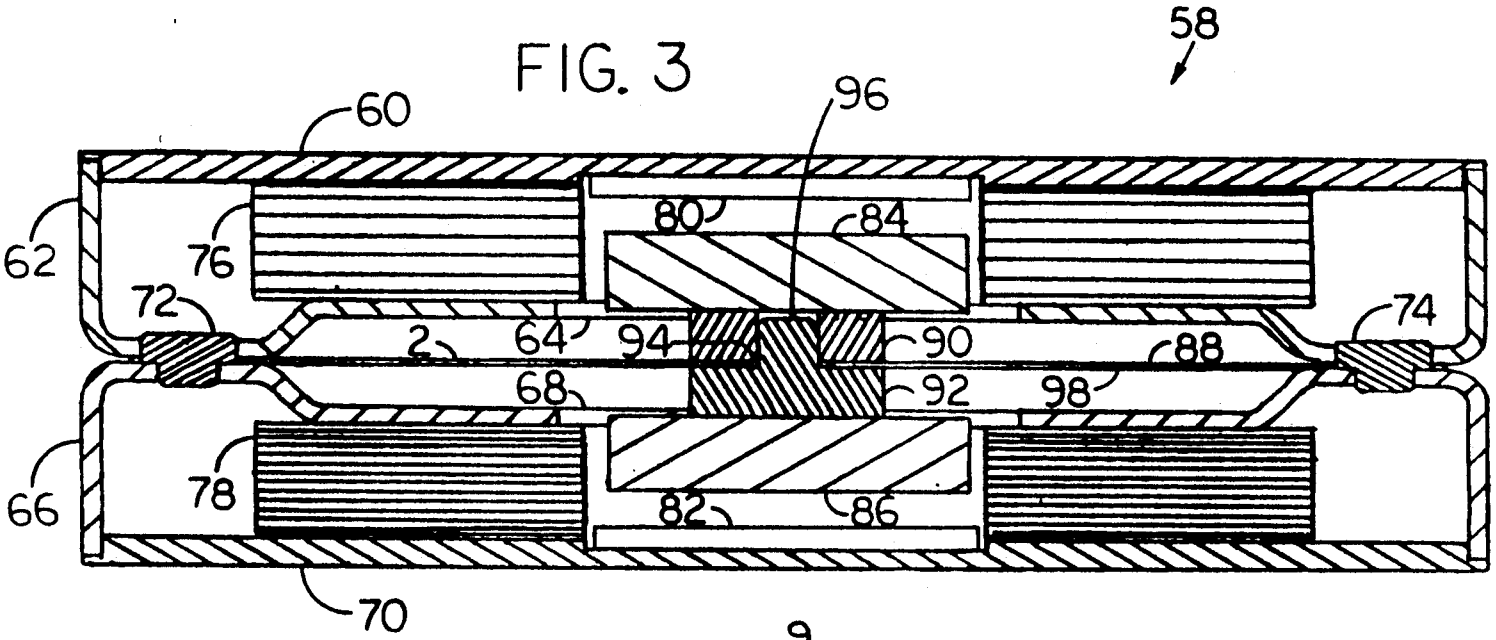
FIG. 3 is a cross sectional view taken along line 7—7 of FIG. 2 of the preferred embodiment of the present invention.

Referring to FIG. 3, the armature 2 is positioned within a disc vibrator 58. In the preferred embodiment, the armature 2 is clamped between two magnetic shielding cups, 62 and 66. The cups 62 and 66 include apertures 64 and 68 to provide for movement of the magnets 84 and 86 within the housing formed by the cups. Two magnetic pole pieces 90 and 92 are contiguous to surfaces 88 and 98, respectively, of armature 2, and two magnets 84 and 86 are contiguous to magnetic pole pieces 90 and 92, respectively. Mounted to the inside of the cups 62 and 66 are two coils 76 and 78 (energized by a power source not shown) that surround each of the magnets, 84 and 86 and are sealed therein by covers 60 and 70. An alternating voltage applied to the coils 76 and 78 alternately attract and repel the magnets 84 and 86, providing a vibration to the center of the armature 2 at the natural resonant frequency of the armature 2. Pads 80 and 82 are contiguous to the covers 60 and 70, respectively, for preventing the magnets 84 and 86 from contacting the covers 60 and 70. At resonance, a maximum amplitude and impulse is provided at a relatively small power consumption. This is due to the restoring force created by tension in the springs 50, 52, 54, and 56 as each member 6, 8, 10, 12, 14, 16, 18, and 20 of springs 50, 52, 54, and 56, extends 0.0015 inches. The restoring force is balanced by the perimeter of the armature 2, which is clamped between magnetic shielding cups 62 and 66. The driving force (unbalanced) is in the axis 9—9 (shown in FIG. 4) and is 10% of the balanced restoring force, which is in the axes 5—5 and 7—7 (shown in FIG. 2). Therefore, the system uses approximately 10% of the stored energy to move the selective call receiver each cycle, which will increase the system's battery life.

The disc vibrator 58 including the armature 2 is less than 0.30 inches in thickness in the preferred embodiment, making it flatter than the conventional, cylindrical shaped vibrator motor 100. The conventional motor 100 generally determines the thickness of the selective call receiver, which is undesirable from a design standpoint. Selective call receivers have tended toward a flatter, rectangular shape, making the disc vibrator 58 necessary in order to achieve this goal. Another advantage of the disc vibrator 58 is that it operates at 200 Hz in the preferred embodiment whereas the cylindrical motor 100 is limited to 60–80 Hz or 3600–4800 RPM's for mechanical reasons. At 60–80 Hz, the motor 100 requires 5.6 times the impulse to provide the same tactile sensory response as generated by the disc vibrator 58 utilizing the diaphragm 2 at 200 Hz. Therefore, the disc vibrator 58 will provide the same tactile sensory response at 200 Hz as the motor 100 provides at 60–80 Hz.

The disc vibrator 58 generates an impulse toward the user in one direction while the motor 100 generates an impulse in all directions; therefore, much of the force generated by the motor 100 is not felt. An equivalent tactile sensory response is then obtained using the disc vibrator 58 while using less power and space than the conventional motor 100. The gravity effect of the disc vibrator 58 is relatively small as compared to the conventional motor 100 since the magnets 90 and 92 are balanced whereas the conventional motor 100 utilizes an unbalanced counterweight 106. The gravity effect on the conventional motor is then dependent on the relationship between the shaft 104 and he unbalanced counterweight 106. Therefore, a further advantage of the disc vibrator 58 is that the gravity effect will result in a smaller reduction in impulse force than the conventional motor 100 due to the resonant nature of the system.

Figure 4:
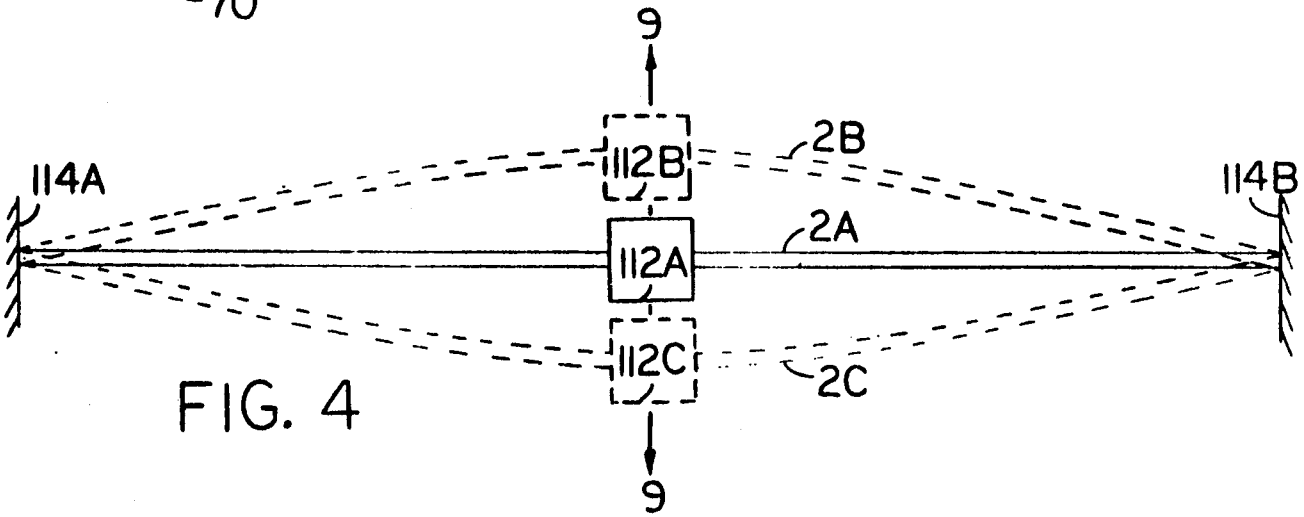
FIG. 4 is a side view of the armature in a vibratory motion.

Referring to FIG. 4, the armature 2A is in its stationary position within disc vibrator 58 with a mass 112A comprised of magnetic pole pieces 90 and 92, and magnets 84 and 86. The armature 2A, 2B, and 2C is held rigid along the perimeter as represented by 114A and 114B. As the disc vibrator 58 begins to vibrate at its resonant frequency, the armature 2A and mass 112A will move from its stationary position, along axis 9—9, to its maximum amplitude as represented by armature 2B and mass 112B. The spring force is provided by springs 50, 52, 54, and 56 along the 9—9 axis. The armature 2B and mass 112B will then oscillate to the opposed extreme as represented by armature 2C and mass 112C. Since the armature 2 is constrained about the perimeter by pins 72 and 74, the vibrator can withstand greater shock without failing compared to the conventional vibrator motor 100 that utilized a rotating shaft and unbalanced counterweight. The disc vibrator 58 is then sensitive to actuating signals and relatively insensitive to physical shock.

The unique feature of the restoring force and spring force is that it is generated from the plane of the axes 5—5 and 7—7 (FIG. 2), which are 90° out of phase with the operational mode of the axis 9—9. In addition, the force is balanced equally by the outer diameter of the armature 2 supporting structure, cups 62 and 66.

The disc vibrator 58 provides a linear spring rate in the axis 9—9 which is accomplished by the elastic bending of the outside diameter of springs 50, 52, 54, and 56 due to tension in the armature 2 in the plane of the axes 5—5 and 7—7 (FIG. 2) during the operational mode described in FIG. 4. This makes the frequency of response independent of the amplitude of deflection and the driving signal. The disc vibrator 58 also provides a frequency of response that is independent of the mass of the pager.

In addition, the disc vibrator 58 provides a fundamental frequency response in a single degree of freedom along the axis 9—9 with the frequency response of the five other secondary degrees of freedom (lateral translation along axis 5—5 or 7—7, and toisional movement of the magnets) being a minimum of one octave higher than the fundamental frequency or twice as high as the frequency of the primary operational mode along axis 9—9. This will prevent energy losses due to mode coupling between the positions represented by the armature 2B and 2C along the axis 9—9 and all remaining modes.

We claim:

1. An apparatus for providing a vibrating motion, comprising:

a resonant planar armature comprising a plurality of independent planar spring members arranged regularly about a central planar region within a planar perimeter region, wherein said spring members provide a restoring force normal to a movement of said central region of said armature;

a housing for enclosing and supporting said armature;

electromagnetic means attached to said housing for effecting an alternating electromagnetic field; and a permanent magnet attached to said central region of said armature, and coupled to said electromagnetic field for alternatively moving said central region of said armature in a first and a second direction in response to the electromagnetic field.

2. The apparatus in accordance with claim 1 wherein said planar perimeter region of said armature has a periphery which is substantially circular.

3. The apparatus in accordance with claim 2 wherein said armature is secured at said periphery by said housing.

4. The apparatus in accordance with claim 1 wherein said plurality planar spring members have a substantially circular geometry.

5. The apparatus in accordance with claim 1 wherein said permanent magnet includes a first magnet and a second magnet attached substantially at the center of said armature above and below said central region.

6. The apparatus in accordance with claim 1 wherein said planar spring members have a substantially rectangular cross-section having a width substantially greater than the thickness.

7. The apparatus in accordance with claim 1 wherein said housing is formed from a sheet metal.

8. An electromagnetic resonant vibrator, comprising:

an armature having a planar circular perimeter region, a planar central region, and a plurality of independent planar circular spring members, arranged regularly around said central region within said perimeter region, and coupled to said perimeter region and to said central region, said spring members providing a restoring force normal to a movement of said central region of said armature;

a permanent magnet, coupled to said central region;

a housing, comprising an upper member and a lower member, coupled to said perimeter region, for enclosing and supporting said armature; and electromagnetic means, located within said housing and coupled to said permanent magnet, for inducing movement of said armature at a predetermined resonant frequency.

9. The electromagnetic resonant vibrator of claim 8, wherein said armature has an upper surface and a lower surface, and wherein said permanent magnet includes a first magnet attached to the upper surface of said central region, and a second magnet attached to said lower surface of said central region.

10. The electromagnetic resonant vibrator of claim 8, wherein said housing is formed from a sheet metal.

11. The electromagnetic resonant vibrator of claim 8, wherein said armature is fabricated from a sheet metal.

12. The electromagnetic resonant vibrator of claim 11, wherein said sheet metal is a nickel alloy.

13. The electromagnetic resonant vibrator of claim 8, wherein said armature includes at least two planar circular spring members for providing a restoring force for the movement of said armature.

14. The electromagnetic resonant vibrator of claim 13, wherein said armature includes four planar circular spring members 15. The electromagnetic resonant vibrator of claim 14, wherein said planar circular spring members are arranged orthogonally around said central region within said perimeter region.

16. The electromagnetic resonant vibrator of claim 13, wherein said armature movement is normal to the direction of the restoring force provided by said planar circular spring members.

17. The electromagnetic resonant vibrator of claim 8, wherein said predetermined resonant frequency of said armature is tunable by adjusting the inside diameter of said planar circular spring members.

* * * * *